United States Patent [19]

Fricker

[11] Patent Number: 4,838,507

[45] **Date of Patent: * Jun. 13, 1989**

[54] PANEL ANCHORING DEVICE

[76] Inventor: Siegfried Fricker, Wurmberger Strasse 30-34, 7135 Wiernsheim, Fed. Rep. of Germany

[ * ] Notice: The portion of the term of this patent subsequent to Apr. 26, 2005 has been disclaimed.

[21] Appl. No.: 141,796

[22] Filed: Jan. 11, 1988

[30] Foreign Application Priority Data

Jan. 10, 1987 [DE] Fed. Rep. of Germany ..... 3700619

[51] Int. Cl.[4] ..... E04F 13/08

[52] U.S. Cl. ..... 248/230; 52/235; 52/714

[58] Field of Search ..... 248/231.9, 230, 231.6; 403/118, 282; 285/420; 52/702, 235, 508, 704, 713, 714

[56] References Cited

U.S. PATENT DOCUMENTS

| | | | |
|---|---|---|---|
| 221,353 | 11/1879 | Potter | 403/282 X |
| 713,537 | 11/1902 | Treadwell | 403/282 |
| 4,147,384 | 4/1979 | Heckethorn | 285/420 X |
| 4,720,952 | 1/1988 | Fricker | 52/235 |
| 4,739,602 | 4/1988 | Fricker | 52/235 X |

*Primary Examiner*—J. Franklin Foss

*Attorney, Agent, or Firm*—Foley & Lardner, Schwartz, Jeffery, Schwaab, Mack, Blumenthal & Evans

[57] ABSTRACT

The anchoring device is for anchoring panels on an anchoring base such as a building wall. The device is simply and inexpensively constructed and includes a tubular support member which is fixed in an axially displaceable manner between clamping plates of angled holders. The support member is located in longitudinal beads formed in the plates, and a serration tooth is arranged inside the longitudinal bead of at least one clamping plate. The clamping plates are formed with openings by means of which threaded screws can tighten the clamping plates around the support member so that the serration tooth is pressed into the wall of the tubular support member.

14 Claims, 1 Drawing Sheet

PANEL ANCHORING DEVICE

BACKGROUND OF THE INVENTION

The invention relates to a device for anchoring panels on an anchoring base such as a building wall or the like.

In anchoring devices of this type it is known to construct the supporting part as a threaded bolt and to position it between two lateral plates of the horizontal supporting part such that it is axially displaceable in a nut thread which can be arranged or made on the two lateral plates. At the same time, unintentional turning of the support can be prevented by additionally counter-locking the threaded connection involving a not inconsiderable effort.

SUMMARY OF THE INVENTION

The object of the invention is to develop a device of the general type described having simple and inexpensively manufactured means for axial adjustment of the horizontal supporting part. The invention further provides for an infinitely variable fine setting of the supporting part independent of threads, and includes a safety feature reliably preventing axial displacement and turning without additional counter-locking.

Details and advantages of the invention will be readily understood as the following description proceeds, in particular reference to the application drawing.

DETAILED DESCRIPTION OF THE PREFERRED EMBODIMENTS

The panel anchoring device 1 according to the invention can be fixed to a building wall or the like via an anchoring element (not shown), such as a plug or screw, and has an angled holder 2 and a support 3. According to the present exemplary embodiment, the support 3 can expediently be constructed as a tube which is of annular shape and cross-section and its wall 4 of such a size that, compared with a cylindrical bolt made of solid material, considerable weight is saved, yet high strength is ensured. Mounting pins (not shown) can be provided on the support 3, on which mounting pins the facing panels to be arranged at a distance from the building wall and secured in position, for example, by engaging the mounting pins in holes made in the facing panels. So that the facing panels can be aligned accurately both relative to one another and with regard to the building wall, a precise adjustment can be made in various directions vertically, horizontally and diagonally by means of the panel anchoring device 1, while readjustments can also be made without the facing panels having to be dismantled. The panel anchoring device 1 is on the whole made with such strength that even very large wind, suction and pressure forces can be absorbed absolutely reliably, so that the facing panels are held firmly and steadily on or in front of the building wall.

Figure 2:
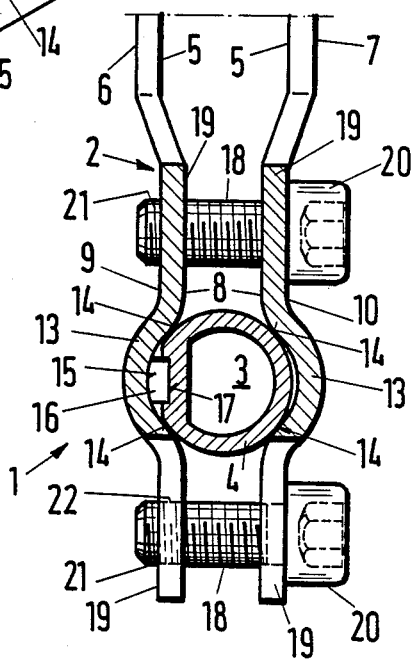
FIG. 2 is a front elevational view partly in section showing the panel anchoring device according to the invention and a tubular support secured thereto.

Each angled holder 2 has a vertical holding part 5 which can be secured in position on the anchoring base, for example, a building wall. Adjacent holders 2 positioned as shown in FIG. 2 thus provide two essentially parallel flat holding struts 6, 7 disposed at right angles to the surface of the anchoring base. The anchoring element, for example, a plug or screw anchor, of conventional construction and accordingly not shown, to be inserted into the building wall can be positioned between the two holding struts 6, 7, which anchoring element presses the holding struts 6, 7 against the wall so that the holder 2 is secured immovably in position.

The horizontal supporting parts 8 of the pair of angled holders 2 comprise two parallel clamping plates 9, 10. The vertical holding struts 6, 7 and the horizontal clamping plates 9, 10 in each case lie approximately in the same vertical parallel planes. Both the holding strut 6 and the clamping plate 9 as well as the holding strut 7 and the clamping plate 10 are made as angled stampings, as a result of which a one-piece embodiment of uniform material is provided which has a high strength and in addition is inexpensive to manufacture. The upper ends 11 of the two holding struts 6, 7 are bent toward one another and connected together by any suitable means, for example, the connection can be made as a spot-welded joint.

On the rear side of the holding struts 6, 7 facing the building wall, C-shaped recesses 12 are formed into which a wedge plate (not shown here) can be inserted. By horizontal displacement of the wedge plate supported on the anchoring element, the panel anchoring device 1 can be infinitely adjusted in the vertical direction.

The two clamping plates 9, 10 each have a longitudinal bead 13 which preferably extends in the horizontal direction over the entire length of the clamping plates 9, 10. The longitudinal bead 13 is configured in a prism shape in cross-section, and in fact in such a way that a part of the periphery of the support tube 3 engages into the longitudinal bead 13. Specifically, two longitudinal edges 14, which define the upper and lower bounds of the longitudinal bead 13, bear approximately linearly against the outside surface of the wall 4 of the support tube 3. Simple and reliable centering of the support 3 between the longitudinal beads 13 of the holders is thereby achieved, so that, advantageously, different support tubes 3 of different diameters can also be used as alternatives. In every case, automatic centering is effected by the longitudinal bead 13 without the curvature of the longitudinal bead 13 having to be adapted to the particular diameter of the support tube 3. Since both clamping plates 9, 10 each have a longitudinal bead 13, the support tube 3 is clamped between a total of four parallel linear longitudinal edges 14.

Figure 1:
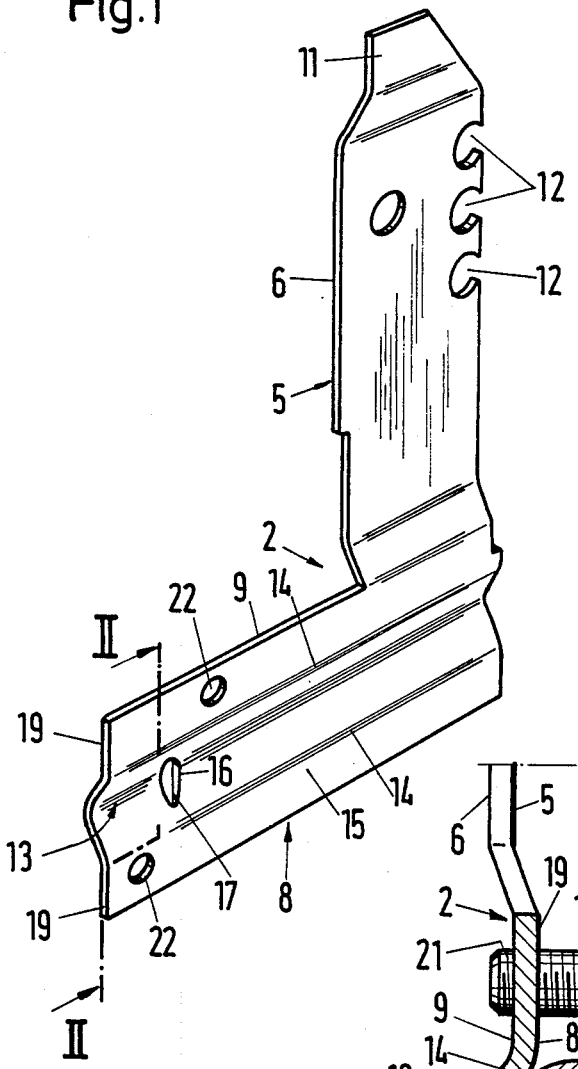
FIG. 1 is a perspective view of an angled holder of the panel anchoring device according to the invention.

In the bead 13 of the clamping plate 9, a single serration tooth 16 is provided which extends inwardly of the inner surface 15 of the clamping plate. The tooth is positioned relatively adjacent the free end area of the supporting part 8. The serration tooth 16 can be fixed on the base of the longitudinal bead 13, e.g. by a welded or riveted connection. In a preferred embodiment, however, the serration tooth 16 can also be made of a uniform material in one piece with the clamping plate 9. For example, a corresponding embossment can be pressed into the clamping plate 9 from the outside against the curvature of the longitudinal bead 13, as a result of which the serration tooth 16, protruding on the inside 15, is formed. FIG. 1 clearly shows that the serration tooth 16 can preferably be made wedge-shaped or chisel-shaped in such a way that a cutting edge 17 and two sloping wedge surfaces are formed. The cutting edge 17 extends transversely to the longitudinal direction of the bead 13 so that it forms a chord inside the arc of the longitudinal bead 13.

The two clamping plates 9, 10, which laterally enclose the support tube 3, are connected by tightening parts which, in the present exemplary embodiment, expediently comprise threaded screws 18. The tubular support 3, on account of the clamping force of the threaded screws 18, is clamped absolutely firm between the clamping plates 9, 10 in the longitudinal bead 13 so that both a positive and non-positive connection is made. The threaded screws 18 are located in the area of two web parts 19 of the clamping plates 9, 10. The longitudinal bead 13 is preferably made symmetric between the two web parts 19 of each clamping plate 9, 10. The threaded screw 18 has a head 20 which can have a hexagon socket for the engagement of an actuating tool and bears against the outside of the web part 19 of clamping plate 10. The threaded screws 18 each pass through an opening in the web part 19 of the clamping plate 10 and, with a threaded end 21, engage threaded openings 22 formed in the opposite web part 19 of the other clamping plate 9. Instead of the threaded openings 22, a threaded nut can also be screwed onto the threaded end 21 of the threaded screw 18. FIG. 1 shows that the two threaded openings 22 are arranged so as to be diagonally offset in opposite directions with respect to the serration tooth 16, and in fact in such a way that the lower threaded opening 22 is further removed from the vertical holding strut 6 than the upper threaded opening 22 formed in the upper web part 19.

FIG. 2 reveals that the serration tooth 16 arranged in the longitudinal bead 13 of the clamping plate 9 is pressed into the wall 4 of the support tube 3 by tightening the threaded screws 18, in the course of which the wall 4 can receded into the hollow interior of the support tube 3 at this location. This results in absolutely reliable interlocking of the support 3 between the clamping plates 9, 10 of the supporting part 8. Moreover, the support tube 3 can neither be displaced in the axial direction nor turned about its longitudinal axis. Nevertheless, in the anchoring device according to the invention, an accurate infinitely variable setting of the support 3 in the supporting part 8 is possible. When the upper and the lower threaded screws 18 are correspondingly slackened, the support tube 3 can be pulled forward axially or pushed back axially and/or turned anticlockwise or clockwise so that individual adjustment is possible and the facing panels can be aligned very accurately. There is a three-point guidance when the support tube 3 is being adjusted in the supporting part 8, with the support tube 3 bearing against the serration tooth and also bearing linearly against the two longitudinal edges 14 of the clamping plate 10 which is not provided with a serration tooth.

When the threaded screws 18 are correspondingly set, easy and accurate adjustment, largely free from play, can thus be achieved, since the support tube 3 is accurately guided in the prism of the longitudinal bead 13. Once adjustment of the support tube 3 is complete, the threaded screws 18 are tightened so that the two clamping plates 9, 10 are pressed firmly against the support tube 3. At the same time, the serration tooth 16, with its cutting edge 17, penetrates deep into the wall 4 of the support 3 until the four longitudinal edges 14 of the two clamping plates 9, 10 bear firmly against the support tube 3. The length of the serration tooth 16 penetrating radially into the support tube 3 can expediently be slightly smaller than the depth of the longitudinal bead 13.

An important advantage of the panel anchoring device 1 according to the invention is that reliable locking of the support 3 in the supporting part 8 is ensured by means of only the one serration tooth 16. In addition, an infinitely variable fine setting of the support 3 is possible and, moreover, manufacture is very inexpensive, since the serration tooth 16 can be produced with the clamping plate without special effort. Overall, the panel anchoring device 1 according to the invention represents an extremely variable anchoring system which makes possible manifold adjustments, which are exceptionally simple to make, for accurately aligning the facing panels. Moreover, the anchoring device can be easily manufactured and has considerable stability, so that an absolutely firm hold of the facing panels is ensured at any set position. Owing to the fact that the beads 13 extend over the entire length of the horizontal supporting part 8, and the serration tooth 16 and the bore 22 are preferably arranged in the area of the free end of the clamping plate 9, simple manufacture and in particular a high stability of the device result. The same purpose is served by the beads 13 being arranged symmetrically to the center of the horizontal supporting part 9, 10 and/or by the angled holders 2 being made as homogenous sheet metal stampings.

The serration tooth 16 preferably lies at right angles to the longitudinal direction of the beads 13 and edges 14 and, in a further exemplary embodiment, can be crossed by a further serration tooth, which preferably lies parallel to the longitudinal beads 13, so that a serration tooth results similar to that of a cross tooth as is generally known in spider wrenches.

What is claimed is:

1. An anchoring device for anchoring panels on an anchoring base such as a building wall or the like, comprising:

(a) a pair of spaced angled holders each of which has a vertically extending holding part adapted to be mounted on an anchoring base, and a generally horizontally extending clamping plate, (b) a serration tooth formed on at least one of said clamping plates and extending inwardly toward the other of said clamping plates, (c) a tubular support member adapted to be positioned between said clamping plates and being further adapted to mount objects to be supported from said anchoring base through said anchoring device, and (d) fastening means interconnecting said clamping plates for tightly clamping said holders around said tubular support member, said serration tooth during such tightening being pressed into and consequently deforming the wall of said tubular support member in such region, said tooth during such period of clamping precluding axial and rotational movement of said support member.

2. The device as claimed in claim 1, wherein a longitudinal bead is formed in each of said clamping plates, said bead being bounded on its top and bottom by longitudinal edges, said tubular support member bearing against the longitudinal edges of the clamping plate opposite the plate formed with said serration tooth, said longitudinal edges being positioned in the upper and lower halves of the tubular support member.

3. The device as claimed in claim 2, wherein said serration tooth is provided in the longitudinal bead of said at least one clamping plate between said longitudinal edges defining said bead.

4. The device as claimed in claim 2, wherein each clamping plate includes web parts above and below said bead, said serration tooth is axially positioned between two openings which are formed in said web parts, with said openings in said at least one clamping plate being threaded, and wherein said fastening means comprise threaded screws engaged in said threaded openings.

5. The device as claimed in claim 3, wherein said serration tooth is wedge-shaped and has a chordlike cutting edge extending transversely to the longitudinal direction of said bead.

6. The device as claimed in claim 1, wherein said serration tooth is integrally formed with said at least one clamping plate.

7. The device as claimed in claim 2, wherein said longitudinal beads extend over the entire length of said clamping plates.

8. The device as claimed in claim 4, wherein said serration tooth and said openings in said clamping plates are arranged in the area of the free or forward ends of said clamping plates.

9. The device as claimed in claim 2, wherein said longitudinal beads are approximately prism shaped.

10. The device as claimed in claim 1, wherein said angled holders are one-piece sheet metal stampings.

11. The device as claimed in claim 2, wherein said beads are arranged symmetrically to the vertical center of said clamping plates.

12. The device as claimed in claim 4, wherein said threaded openings are arranged horizontally at a lateral distance from the serration tooth on a sloping line passing through said serration tooth.

13. The device as claimed in claim 4, wherein said serration tooth is arranged at right angles to said longitudinal bead, and is crossed by a serration tooth preferably lying parallel to said bead.

14. The device as claimed in claim 1, wherein the connection of said fastening means to said clamping plates is such that the temporary release of said fastening means permits guided axial or rotative movement of said support member to its most desired position, after which the fastening means can again be tightened to press said tooth into the wall of said support member to maintain the same in its adjusted position.

* * * * *